US007527001B2

(12) United States Patent
Li

(10) Patent No.: US 7,527,001 B2
(45) Date of Patent: May 5, 2009

(54) BOGIE APPARATUS

(76) Inventor: Lingqun Li, Tower A, Bldg., No. 14, Chuangye Yuan, Shuang D Gang, Gaoxinyuanqu, No. 12, Liaohedonglu, Dalian (CN) 116620

( * ) Notice: Subject to any disclaimer, the term of this patent is extended or adjusted under 35 U.S.C. 154(b) by 434 days.

(21) Appl. No.: 11/508,527

(22) Filed: Aug. 23, 2006

(65) Prior Publication Data

US 2007/0046409 A1 Mar. 1, 2007

(30) Foreign Application Priority Data

Aug. 25, 2005 (CN) ..... 200510093323

(51) Int. Cl.
*B60L 13/10* (2006.01)

(52) U.S. Cl. ..... 104/281; 104/283; 104/286

(58) Field of Classification Search ..... 104/281–286; 335/306

See application file for complete search history.

(56) References Cited

U.S. PATENT DOCUMENTS 6,510,799 B2 1/2003 Lamb et al.
6,899,036 B2 5/2005 Lamb et al.
7,197,987 B2 * 4/2007 Falter et al. ..... 104/281
7,204,192 B2 4/2007 Lamb et al.

OTHER PUBLICATIONS

Printouts from website www.levx.com/gallery/p1.html from Aug. 2004 (six pages).
Printout from website www.levx.com/images/gallery/pics/airgap7.jpg from Aug. 2004 (one page).
Printout from website www.levx.com/gallery/vidclips.html from Aug. 2004 (one page).

* cited by examiner

*Primary Examiner*—Ramon M Barrera

(57) ABSTRACT

A bogie apparatus includes a chassis, rotation bogie parts respectively disposed at both ends of the chassis, and a composite motion bogie part located at a middle portion of the chassis. Each of said rotation bogie parts includes a circular upper inner ring permanent magnet fixed on a lower surface or a bottom surface of the chassis. A first bogie located under the chassis and having a bogie body is also added. A circular lower inner ring permanent magnet disposed on an upper surface or a top surface of the bogie body of the first bogie may be included. The inner ring may have inner and outer diameters substantially identical to those of the upper inner ring permanent magnet, and aligned with the upper inner ring permanent with a predetermined distance therebetween.

12 Claims, 4 Drawing Sheets

BOGIE APPARATUS

BACKGROUND OF THE INVENTION

1. Field of the Invention

The present application relates to a vehicle for transport, and particularly to a bogie apparatus.

2. Description of the Related Art

In order to ensure that wheel-rail trains, magnetic levitation trains, and long vehicle have good turning and slope climbing performance, bogies are provided under chassis of these vehicles. Generally, chassis of vehicles are supported on springs of front and back bogies, and connected together with the front and back bogies by means of shafts, respectively. The bogies under the chassis can rotate horizontally and incline backward and forward at a small angle so that the vehicle can run on curved and inclined road.

The above bogies are complex in structure, difficult in manufacture, great in friction coefficient when rotating, concentrative in stress generated by loads thereon, bad in comfortableness for passengers, short in life, and so on. Importantly, such a bogie arrangement in which two bogies are rotatably disposed at both ends of a vehicle is disadvantageous to an increase in length of the vehicle and a uniform distribution of load of the vehicle on a road.

The above mentioned techniques are well known knowledge widely used in the conventional wheel-rail trains, magnetic levitation trains, and long vehicles. The knowledge can be found in any related professional books, and the detailed description thereof is omitted for brevity.

SUMMARY OF THE INVENTION

The present application is made in view of the above problems of the prior art. It is an object of the present invention to provide a bogie apparatus which at least partly solves the above problems existing in the prior art.

According to an aspect of the present invention, a bogie apparatus comprises: a chassis, rotation bogie parts respectively disposed at both ends of the chassis, and a composite motion bogie part located at a middle portion of the chassis, wherein each of said rotation bogie parts includes: a circular upper inner ring permanent magnet fixed on a lower surface or a bottom surface of the chassis; a first bogie located under the chassis and having a bogie body; a circular lower inner ring permanent magnet disposed on an upper surface or a top surface of the bogie body of the first bogie, having inner and outer diameters substantially identical to those of the upper inner ring permanent magnet, and aligned with the upper inner ring permanent with a predetermined distance there between, with identical poles of the lower and upper inner ring permanent magnets facing each other so as to generate a repulsion levitation force there between for levitating a car above the chassis; a first upper sleeve fixed to the chassis and coaxial with the upper inner ring permanent magnet; a first lower sleeve mounted to the bogie body of the first bogie and coaxial with the lower inner ring permanent magnet and the first upper sleeve; and a first shaft having an upper end fitted in the first upper sleeve in such a manner that it can rotate, and slide up and down therein, and a lower end fixed in the first lower sleeve, and wherein the composite motion bogie part comprises: a plurality of upper strap permanent magnets arranged substantially parallel to one another at a predetermined interval and fixed on the lower surface of the chassis, the plurality of upper strap permanent magnets being substantially parallel to a transverse direction substantially perpendicular to a longitudinal direction of the chassis; a second bogie located under the chassis and having a bogie body; a plurality of lower strap permanent magnets arranged parallel to one another and fixed on an upper surface or a top surface of a bogie body of the second bogie, the upper strap permanent magnets and the lower strap permanent magnets being aligned with each other, with identical poles of the upper strap permanent magnets and the lower strap permanent magnets facing each other, and a predetermined air gap existing between the upper strap permanent magnets and the lower strap permanent magnets, thereby generating a further repulsion levitation force for levitating the car; a translation track base fixed to the chassis at a center of the plurality of upper strap permanent magnets, and having a guide track parallel to the upper strap permanent magnets; a translation sleeve fitted in the translation track base and movable along the guide track; a second lower sleeve mounted on the bogie body of the second bogie at a center of the lower strap permanent magnets; and a second shaft having an upper end fitted in the translation sleeves in such a manner that it can rotate and slide up and down therein, and a lower end fixed in the second lower sleeve.

In order to achieve the object of the present invention, the present invention provides a bogie apparatus composed of rotation bogie parts respectively disposed at both ends of a chassis and a composite motion bogie part located at a middle portion of the chassis, wherein the rotation bogie parts at both ends are identical in structure to each other, and each of the rotation bogie parts comprises: a continuous circular upper inner ring permanent magnet and a plurality of discontinuous circular upper outer ring permanent magnets both fixed on a lower surface of the chassis, the upper outer ring permanent magnets being located diametrically outside the upper inner ring permanent magnet, and the upper outer ring permanent magnets and the upper inner ring permanent magnet being arranged concentrically; a continuous circular lower inner ring permanent magnet and a plurality of discontinuous circular lower outer ring permanent magnets both fixed on an upper surface of a bogie body of a bogie, the lower outer ring permanent magnets being located diametrically outside the lower inner ring permanent magnet, and the lower outer ring permanent magnets and the lower inner ring permanent magnet being arranged concentrically; the upper inner ring permanent magnet and the lower inner ring permanent magnet being aligned with each other, with identical poles of the upper inner ring permanent magnet and the lower inner ring permanent magnet facing each other respectively, and an air gap of 3-100 mm being formed between the upper inner ring permanent magnet and the lower inner ring permanent magnet; coaxial upper and lower sleeve holes formed in the chassis and the bogie body at centers of the upper inner ring permanent magnet and the lower inner-ring permanent magnet respectively; upper and lower sleeves fixed to the upper and lower sleeve holes, respectively; a shaft having one end fitted in the upper sleeves in such a manner that it can rotate and slide up and down therein, and the other end fixed in the lower sleeve; a position limiting cover disposed above the upper sleeve and fixed to said one end of the shaft; wherein with the above configurations of the rotation bogie part, the upper and lower inner ring permanent magnets, and upper and lower outer ring permanent magnets generate a repulsion levitation force for levitating a car, thereby increasing an area of the chassis of a vehicle on which the force acts, and the composite motion bogie part comprises: a plurality of upper strap permanent magnets arranged parallel to one another and fixed on the lower surface of the chassis; a plurality of lower strap permanent magnets arranged parallel to one another and fixed on an upper surface of a bogie body of a further bogie;

the upper strap permanent magnets and the lower strap permanent magnets being aligned with one another, with identical poles of the upper strap permanent magnets and the lower strap permanent magnets facing each other, and an air gap of 3-100 mm existing between the upper strap permanent magnets and the lower strap permanent magnets; further coaxial upper and lower sleeve holes formed respectively in the chassis and the bogie body of the further bogie at centers of the upper strap permanent magnets and the lower strap permanent magnets; a translation track base fixed to the further upper sleeve holes of the chassis and having a guide track parallel to the upper strap permanent magnets; a translation sleeve fitted in the translation track base; a further lower sleeve fixed to the further lower sleeve hole of the bogie body of the further bogie; a further shaft having: one end fitted in the translation sleeves in such a manner that it can rotate, and slide up and down therein, and the other end fixed in the further lower sleeve, the further shaft also being capable of horizontally sliding in a direction perpendicular to a direction in which a vehicle runs, along with the translation sleeve, thereby making a composite motion; a further position limiting cover disposed above the translation sleeve and fixed to the further shaft so that the shaft cannot be drawn out of the translation sleeve; wherein with the above configuration of the composite motion bogie part, the same poles of the upper and lower strap permanent magnets face each other and thus the upper and lower strap permanent magnets generate a further repulsion levitation force for levitating the car, thereby increasing the area of the chassis of the vehicle on which the force acts.

A bush may be provided between the upper sleeve of the bogie of the rotating bogie part and the shaft.

Each of the upper strap permanent magnets may comprise a plurality of short strap permanent magnets arranged at an interval equal to or greater than 50 mm.

Each of the lower strap permanent magnets may comprise a plurality of short strap permanent magnets arranged at an interval equal to or greater than 50 mm.

A further bush may be provided between the translation sleeve of the further bogie of the composite motion bogie part and the further shaft.

The bogie apparatus according to the present invention is simple in structure, friendly to manufacturing process, small in friction coefficient when the bogies rotate, uniform in stress generated by loads acting thereon, good in comfortableness for passengers, and long in life. Furthermore, a composite motion bogie part is arranged under the chassis between the front and back rotating bogie parts, thereby achieving an effect of uniform distribution of a load of the vehicle on a road even when the vehicle or the car is lengthened.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1A:
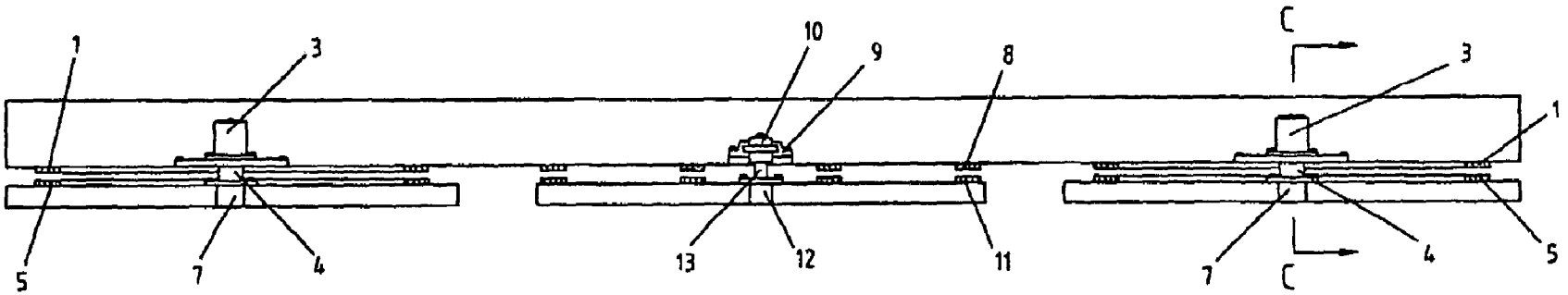
FIGS. 1*a* and 1*b* are schematic side and plan views respectively showing a structure of a bogie apparatus according to the present application.

Reference will now be made in detail to the present embodiments of the present invention, examples of which are illustrated in the accompanying drawings, wherein like reference numerals refer to the like elements throughout. The embodiments are described below in order to explain the present invention by referring to the figures. However, the present application is not limited to the embodiments.

Figure 1B:
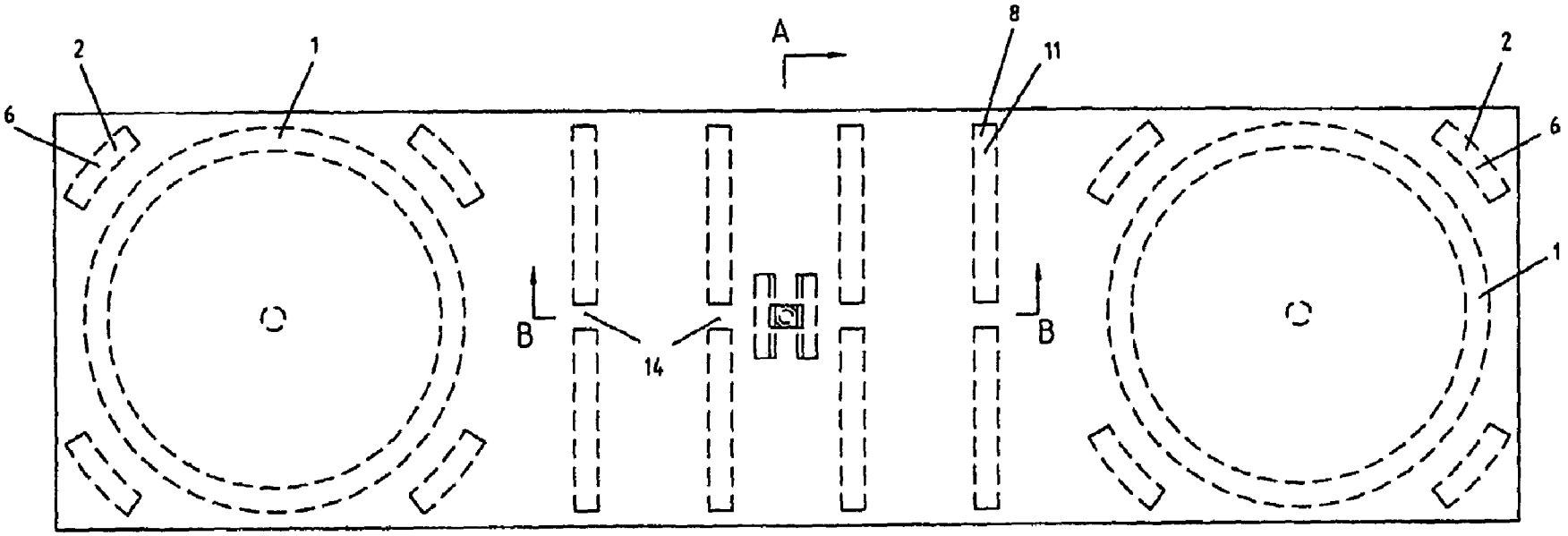
Figure 2:
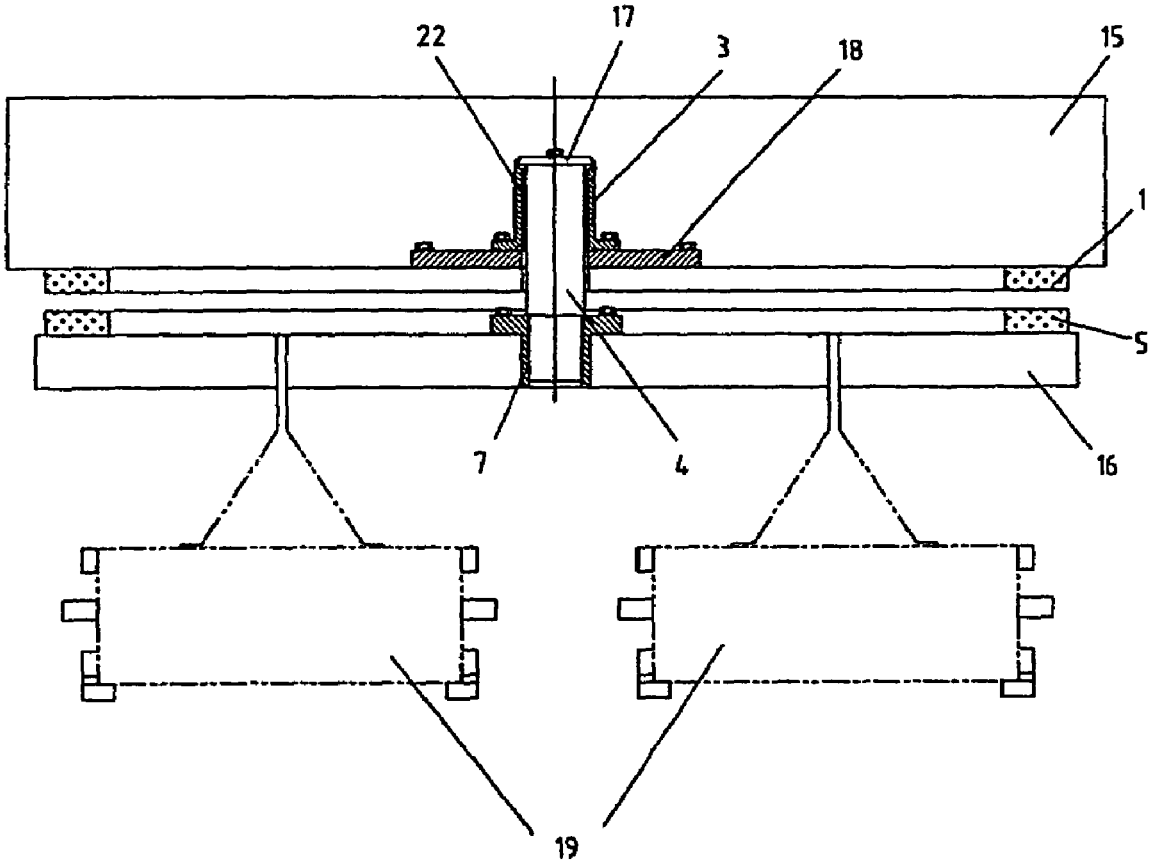
FIG. 2 is a schematic sectional view taken along a line C-C of FIG. 1.

FIGS. 1 and 2 show side and plan views of a bogie apparatus according to the present application, respectively. The bogie apparatus according to the present application is composed of front and back rotation bogie parts respectively disposed at both ends of a chassis and a composite motion bogie part located at a middle portion of the chassis, wherein the front and the back rotation bogie parts are identical in structure to each other, and thus only one rotation bogie part will be described for purpose of brevity.

The rotation bogie parts comprises: an upper inner ring permanent magnet 1, an upper outer ring permanent magnet 2, a shaft 4, a lower inner ring permanent magnet 5, and a lower outer ring permanent magnet 6.

The upper inner ring permanent magnet 1 is a continuous circular ring and is fixed on a lower surface or a bottom surface of the chassis 15. The upper outer ring permanent magnet 2 is an discontinuous circular ring and fixed on the lower surface or the bottom surface of the chassis 15 while being located outside the upper inner ring permanent magnet 1. The upper inner ring permanent magnet 1 and the upper outer ring permanent magnet 2 are arranged concentrically. That is, they have an identical central rotation axis. An upper sleeve 3 is disposed to the chassis 15 at the central rotation axis.

The lower inner ring permanent magnet 5 is a continuous circular ring and is fixed on an upper surface or a top surface of a bogie body 16 of a bogie. The lower outer ring permanent magnet 6 is a discontinuous circular ring and fixed on the upper surface or the top surface of the bogie body 16 while being located outside the lower inner ring permanent magnet 5. The lower inner ring permanent magnet 5 and the lower outer ring permanent magnet 6 are arranged concentrically, that is, they have an identical central rotation axis. A lower sleeve 7 is disposed to the bogie body 16 at the central rotation axis.

A shaft 4 has one end fixed in the lower sleeve 7 of the bogie body 16 and the other end fitted in the upper sleeve 3 of the chassis 15, so that the chassis 15 located above and the bogie body 16 located below are rotatably connected to each other via the shaft 4. In addition, a position limiting cover 17 is disposed above a top of the upper sleeve 3 of the chassis 15 and fixed to the shaft 4 to restrict the shaft so that the shaft 4 can only rotate and slide up and down in the upper sleeve 3 and can not be drawn out of the upper sleeve 3.

After the chassis 15 and the bogie body 16 are connected via the shaft 4, the upper inner ring permanent magnet 1 and the upper outer ring permanent magnet 2 fixed on the chassis 15 are aligned with the lower inner ring permanent magnet 5 and the lower outer ring permanent magnet 6 fixed on the bogie body 16, and identical poles of the upper inner ring permanent magnet 1 and the upper outer ring permanent magnet 2 fixed on the chassis 15 and the lower inner ring permanent magnet 5 and the lower outer ring permanent magnet 6 fixed on the bogie body 16 face one another. As show in FIG. 1*b*, in an assembled state, the upper inner ring permanent magnet 1 is superposed on or coincided with the lower inner ring permanent magnet 5 in the plan view, and the upper outer ring permanent magnet 2 is superposed on or coincided with the lower outer ring permanent magnet 6 in the plan view. An air gap of 3-100 mm is formed between the upper inner ring permanent magnet 1 and the upper outer ring permanent magnet 2 fixed on the chassis 15 and the lower inner ring permanent magnet 5 and the lower outer ring permanent magnet 6 fixed on the bogie body 16.

With the above configuration, the shaft 4 assures that the upper inner ring permanent magnet 1 and the upper outer ring permanent magnet 2 fixed on the chassis 15 and the lower inner ring permanent magnet 5 and the lower outer ring permanent magnet 6 fixed on the bogie body 16 strictly correspond to one another, so that they cannot be horizontally displaced relative to one another when the chassis 15 and the bogie body 16 rotate horizontally and incline backward and forward at a small angle. Since the same poles face each other, a repulsion levitation force for levitating a car is generated. A net magnetic energy of the repulsion levitation force decreases with an increase of the air gap according to the law of a power function. This magnetic field of a circular ring arrangement increases an area of the chassis on which the force acts, so that a load acting on the chassis is dispersed and thus life of the bogie apparatus can be prolonged.

In order to increase the rotary performance of the shaft 4, a bush 22 is provided between the shaft 4 and the upper sleeve 3. A magnetic levitation force and power chamber 19 is disposed under the bogie body 16 as a magnetic levitation force and power device of the vehicle. Since the magnetic levitation force and power chamber 19 is well known and is not a key point of the present application, the detailed description thereof is omitted.

Figure 3:
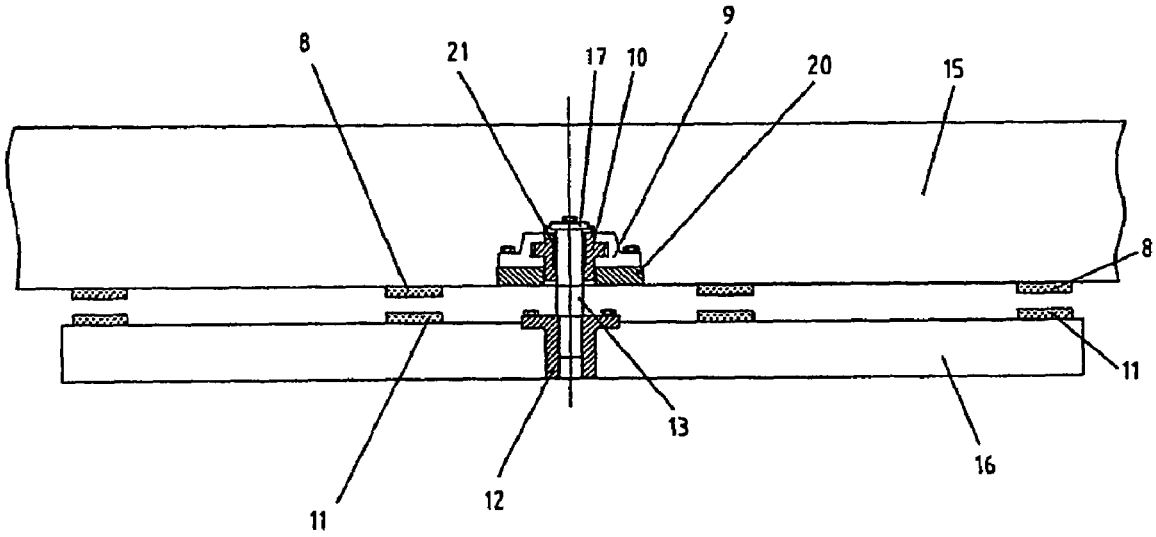
FIG. 3 is a schematic sectional view taken along a line B-B of FIG. 1.
Figure 4:
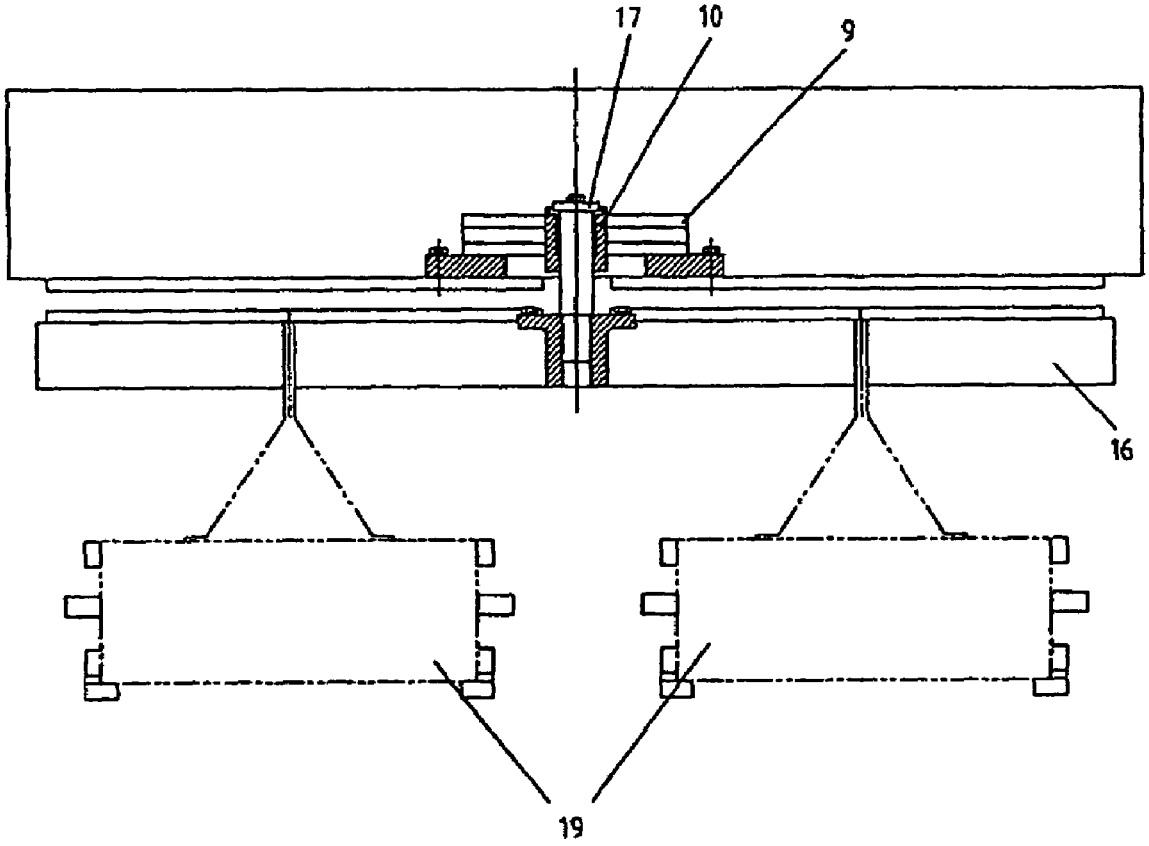
FIG. 4 is a schematic sectional view taken along a line A-A of FIG. 1.

Referring to FIGS. 1, 3, and 4, a composite motion bogie part is disposed at a middle position of the chassis 15. The composite bogie part comprises a plurality of upper strap permanent magnets 8 arranged parallel to one another across the chassis 15 and fixed on the lower surface of the chassis 15. A plurality of lower strap permanent magnets 11 corresponding to the plurality upper strap permanent magnets 8 in a one-to-one manner are fixed on an upper surface of a bogie body 16 of a further bogie. Identical poles of the upper strap permanent magnets 8 and the lower strap permanent magnets 11 face each other, and there is an air gap of 3-100 mm between the upper strap permanent magnets 8 and the lower strap permanent magnets 11. As show in FIG. 1*b*, in an assembled state, the upper strap permanent magnets 8 is superposed on or coincided with the lower strap permanent magnets 11 in the plan view. Each of the upper strap permanent magnets 8 and the lower strap permanent magnets 11 may be formed by a one-piece strap permanent magnet, or a plurality of short strap permanent magnets arranged across the chassis 15 at an interval equal to or greater than 50 mm. That is, there is a gap of ≧50 mm between two adjacent short strap permanent magnets. In an embodiment as shown in FIG. 1*b*, four rows of the upper strap permanent magnets 8 and the lower strap permanent magnets 11 are provided, and each row of the four rows of the strap permanent magnets is composed by two short strap permanent magnets. However, the present application is not limited to the above embodiment, the arrangement of the upper strap permanent magnets 8 and the lower strap permanent magnets 11 may be varied as desired. A translation track base 9 is mounted at a shaft hole position on the chassis 15 at a center of the plurality of the upper strap permanent magnets 8. A translation sleeve 10 is disposed in the translation track base 9. A lower sleeve 12 of the composite motion bogie part is disposed on the bogie body 16 at a center of the plurality of the lower strap permanent magnets 11.

A shaft 13 of the composite motion bogie part has one end fixed in the lower sleeve 12 of the composite motion bogie part, and the other end fitted in the translation sleeve 10 of the chassis 15, so that the chassis 15 located above and the bogie body 16 located below are rotatably connected to each other through the shaft 13. In addition, a position limiting cover 17 is disposed above a top of the translation sleeve 10 and connected to the shaft 13 to limit the shaft 13 so that the shaft 13 cannot be drawn out of the translation sleeve 10. With the above configurations, the shaft 13 of the composite motion bogie part can rotate and slide up and down in the translation sleeve 10, and can horizontally slide transversely along with the translation sleeve, thereby achieving a composite motion. Among the three motions, the horizontal motion and the up and down sliding motion are primary ones, while the rotation is a minor secondary one, so that the magnetic levitation force is not adversely affected. With the above configurations, a problem in turning of a long car is solved by coupling of the road and the vehicle.

The operation principle of the bogie apparatus according to the present application is as follows: the rotation bogie parts disposed at both front and back ends of the chassis only rotate horizontally, while the composite motion bogie part located at the middle portion of the chassis horizontally translates in a left and right direction and rotates. A distance of the translation is inversely proportional to a radius of curvature of the swerving vehicle, but the rotation is minor. Therefore, the present application solves the problem in the scenario that the long car swerves on a road of a small radius of curvature.

The bogie apparatus according to the present application may be applied to magnetic levitation trains, wheel-rail trains, and long cars. The bogie apparatus according to the present application has the following advantages.

1. The bogie apparatus according to the present invention is simple in structure, small in friction, flexible in turning, and long in life.

2. The area on which the force acts between the chassis and the bogie bodies is enlarged, and the load is dispersed. In addition, the air gap does not transfer vibration between lower and upper structures of the vehicle and thus resonance cannot occur. As a result, the vehicle is safe and comfortable.

3. The bogie apparatus is simple in manufacturing process and its manufacturing cost is low.

4. A length of the vehicle can be increased and the load of the vehicle on the road can be distributed uniformly.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A bogie apparatus, comprising: a chassis, rotation bogie parts respectively disposed at both ends of the chassis, and a composite motion bogie part located at a middle portion of the chassis, wherein each of said rotation bogie parts includes:

a circular upper inner ring permanent magnet fixed on a lower surface or a bottom surface of the chassis;

a first bogie located under the chassis and having a bogie body;

a circular lower inner ring permanent magnet disposed on an upper surface or a top surface of the bogie body of the first bogie, having inner and outer diameters substantially identical to those of the upper inner ring permanent magnet, and aligned with the upper inner ring permanent with a predetermined distance there between, with identical poles of the lower and upper inner ring permanent magnets facing each other so as to generate a repulsion levitation force there between for levitating a car above the chassis;

a first upper sleeve fixed to the chassis and coaxial with the upper inner ring permanent magnet;

a first lower sleeve mounted to the bogie body of the first bogie and coaxial with the lower inner ring permanent magnet and the first upper sleeve; and a first shaft having: an upper end fitted in the first upper sleeve in such a manner that it can rotate and slide up and down therein; and a lower end fixed in the first lower sleeve, and wherein the composite motion bogie part comprises:

a plurality of upper strap permanent magnets arranged substantially parallel to one another at a predetermined interval and fixed on the lower surface of the chassis, the plurality of upper strap permanent magnets being substantially parallel to a transverse direction substantially perpendicular to a longitudinal direction of the chassis;

a second bogie located under the chassis and having a bogie body;

a plurality of lower strap permanent magnets arranged parallel to one another and fixed on an upper surface or a top surface of a bogie body of the second bogie, the upper strap permanent magnets and the lower strap permanent magnets being aligned with each other, with identical poles of the upper strap permanent magnets and the lower strap permanent magnets facing each other, and a predetermined air gap existing between the upper strap permanent magnets and the lower strap permanent magnets, thereby generating a further repulsion levitation force for levitating the car;

a translation track base fixed to the chassis at a center of the plurality of upper strap permanent magnets, and having a guide track parallel to the upper strap permanent magnets;

a translation sleeve fitted in the translation track base and movable along the guide track;

a second lower sleeve mounted on the bogie body of the second bogie at a center of the lower strap permanent magnets; and a second shaft having: an upper end fitted in the translation sleeves in such a manner that it can rotate and slide up and down therein; and a lower end fixed in the second lower sleeve.

2. The apparatus according to claim 1, wherein each of said rotation bogie parts further includes:

a circular upper outer ring permanent magnet having an inner diameter greater than an outer diameter of the upper inner ring permanent magnet, and the upper outer ring permanent magnet and the upper inner ring permanent magnet being arranged coaxially on the lower surface of the chassis; and a circular lower outer ring permanent magnet having an inner diameter greater than an outer diameter of the lower inner ring permanent magnet, and having an inner diameter and an outer diameter substantially identical to those of the upper outer ring permanent magnet, the lower outer ring permanent magnet and the lower inner ring permanent magnet being arranged coaxially on the upper surface of the bogie body of the first bogie, and the lower outer ring permanent magnet being aligned with the upper outer ring permanent magnet with a predetermined distance there between.

3. The apparatus according to claim 2, wherein each of the upper outer ring permanent and the lower outer ring permanent magnet is composed of a plurality of arc sections, the plurality of arc sections having same inner and outer diameters and being arranged along the same circular ring, wherein the arc sections of the upper outer ring permanent and the arc sections of the lower outer ring permanent magnet are identical in number to each other and aligned with each other.

4. The apparatus according to claim 3, wherein each of the upper outer ring permanent and the lower outer ring permanent magnet is composed of four arc sections.

5. The apparatus according to claim 1, wherein the predetermined distance between the upper inner ring permanent magnet and the lower inner ring permanent magnet is about 3-100 mm and/or the predetermined distance between the upper outer ring permanent magnet and the lower outer ring permanent magnet is about 3-100 mm.

6. The apparatus according to claim 5, wherein each of said rotation bogie parts further comprises a first bush provided between the first upper sleeve and the first shaft.

7. The apparatus according to claim 1, wherein each of said rotation bogie parts further comprises a position limiting cover disposed above the first sleeve and connected to the first shaft to prevent the first shaft from being drawn out of the translation sleeve.

8. The apparatus according to claim 1, wherein the air gap between the upper strap permanent magnets and the lower strap permanent magnets is about 3-100 mm.

9. The apparatus according to claim 1, wherein each of the upper strap permanent magnets is composed of a plurality of short strap permanent magnets arranged at a predetermined interval.

10. The apparatus according to claim 9, wherein the predetermined interval is equal to or greater than about 50 mm.

11. The apparatus according to claim 1, wherein the composite motion bogie part further comprises a bush provided between the translation sleeve and the second shaft.

12. The apparatus according to claim 1, wherein the composite motion bogie part further comprises a position limiting cover disposed above the translation sleeve and connected to the second shaft to prevent the second shaft from being drawn out of the translation sleeve.

* * * * *